United States Patent [19]

von König et al.

[11] 4,358,531

[45] Nov. 9, 1982

[54] PHOTOGRAPHIC MATERIAL, PROCESS FOR THE PRODUCTION THEREOF AND PROCESS FOR THE PRODUCTION OF PHOTOGRAPHIC IMAGES

[75] Inventors: Anita von König, Krefeld; Franz Moll, Leverkusen; Lothar Rosenhahn, Cologne, all of Fed. Rep. of Germany

[73] Assignee: Agfa-Gevaert Aktiengesellschaft, Leverkusen, Fed. Rep. of Germany

[21] Appl. No.: 309,972

[22] Filed: Oct. 9, 1981

[30] Foreign Application Priority Data

Oct. 16, 1980 [DE] Fed. Rep. of Germany ..... 3039168

[51] Int. Cl.[3] ..... G03C 1/34

[52] U.S. Cl. ..... 430/434; 430/569; 430/607

[58] Field of Search ..... 430/607, 591, 569, 434

[56] References Cited

U.S. PATENT DOCUMENTS

| | | | |
|---|---|---|---|
| 2,507,114 | 5/1950 | McQueen | 430/467 |
| 3,342,599 | 9/1967 | Reeves | 430/371 |
| 3,386,831 | 6/1968 | Honig et al. | 430/607 |
| 3,881,939 | 5/1975 | Noda et al. | 430/613 |
| 3,982,044 | 9/1976 | Matsuyama et al. | 430/591 |

*Primary Examiner*—J. Travis Brown

*Attorney, Agent, or Firm*—Connolly and Hutz

[57] ABSTRACT

Compounds of the formula

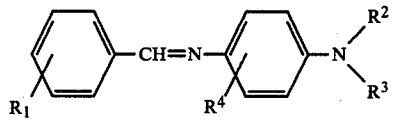

(I)

wherein the substituents have the meaning indicated in the specification are suitable as latent image stabilizer in silver halide materials.

8 Claims, No Drawings

PHOTOGRAPHIC MATERIAL, PROCESS FOR THE PRODUCTION THEREOF AND PROCESS FOR THE PRODUCTION OF PHOTOGRAPHIC IMAGES

This invention relates to a photographic material containing a latent image stabiliser, to a process for the production of this material and to a process for the production of photographic images.

It is known that the latent image nuclei of exposed silver halide emulsions are not stable in storage. This phenomenon has been described, for example, in "The Theory of the Photographic Process", 4th Edition, Macmillan Publishing Co., New York, 1977, pages 167 et seq.

Fading of the latent image is usually manifested by the fact that an exposed material which was stored before development is less sensitive than a material which was not stored after exposure. The causes of fading of the latent image have not been completely clarified, but it is assumed to be released by substances in the emulsion, such as impurities or additives, for example, which oxidise part of the silver constituting the latent image. Fading of the latent image is a serious nuisance in practice, not only in photographic recording materials, which are usually stored for some time after exposure before they are developed, but also in copying materials if these are not developed immediately after exposure. It is particularly when copying materials are processed in the form of rolls that often they are not developed until several days after exposure.

It is known to add so-called "latent image stabilisers" to photographic silver halide emulsions to stabilise the latent image nuclei. Latent image stabilisers have been described, for example, in German Offenlegungschrift No. 2,827,937, in British Pat. Nos. 1,343,904; 1,412,294; 1,378,354; 1,386,630; 1,453,388 and 1,458,107 and in U.S. Pat. Nos. 3,386,831 and 3,881,939.

It is an object of the present invention to achieve improved latent image stabilisation.

The following have now been found:

(1) A photographic material consisting of a layer support, at least one light-sensitive silver halide emulsion layer applied to this support and optionally other layers, at least one layer containing a compound corresponding to the following general formula (I) in a quantity of at the most $10^{-2}$ mol per mol of silver halide:

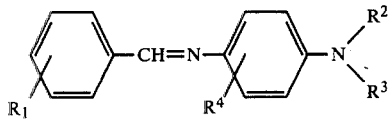

(I)

wherein $R^1$ represents H, hydroxyl or halogen;

$R^2$ and $R^3$, which may be the same or different, represent H, substituted or unsubstituted alkyl having from 1 to 4 carbon atoms or acyl;

$R^4$ represents H or alkyl having from 1 to 4 carbon atoms;

$R^1$ preferably represents H or OH;

$R^2$ and $R^3$ preferably represent alkyl having from 1 to 3 carbon atoms, with or without substituents. The hydroxyl group and the N-methyl sulphonamide group are preferred substituents. $R^2$ also preferably represents acetyl. $R^3$ also preferably represents H;

$R^4$ preferably represents H or methyl.

(2) A process for the production of a photographic material containing at least one silver halide emulsion layer by precipitation of the silver halide in the presence of a protective colloid, optionally physical and chemical ripening and application of the resulting casting solution to a layer support, characterised in that a compound corresponding to general formula (I) is added in a quantity of at the most $10^{-2}$ mol per mol of silver halide before the casting solution is applied.

(3) A process for the production of photographic images by image-wise exposure and development of the material according to the present invention.

The compounds to be used according to the present invention are so-called "Schiff's bases". It is known to add such compounds to photographic recording materials as masked developer substances, but in that case they are, of course, used at concentrations of the same order of magnitude as the silver halide. It is also known from U.S. Pat. No. 3,342,599 to use Schiff's bases preferably in quantities of from 0.5 to 2.5 mol per mol of silver halide as development precursors in photographic recording materials. There is, however, nowhere any indication that the compounds to be used according to the present invention act as latent image stabilisers at a concentration of at the most $10^{-2}$ mol per mol of silver halide. Furthermore, it follows from column 2, line 10 of U.S. Pat. No. 3,342,599 that the compounds indicated there hydrolyse and become active only at a pH above 9. No such pH occurs in conventional photographic recording materials during the time between exposure and development, but it is precisely during this period that the latent image stabilisers added are required to prevent fading of the latent image. It would therefore have been expected that the compounds to be used according to the present invention would be ineffective as latent image stabilisers. This, however, is not the case, as will be clear from the Examples given below. From U.S. Pat. Nos. 3,227,552; 3,227,550 and 3,243,294, it is also known to use Schiff's bases as developers for the production of direct positive images. Again, no indication is given that the compounds to be used according to the present invention could act as latent image stabilisers at the given concentrations. It is known from U.S. Pat. No. 2,507,114 to use Schiff's bases substituted with a carboxyl or sulphonic acid group as developer substances in photographic materials. This reference again contains no indication of the use according to the present invention.

The compounds corresponding to general formula (I) given in the following Table (I) have proved to be particularly suitable.

TABLE 1

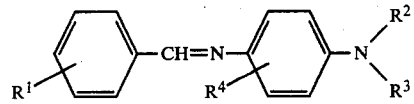

| No. | $R^1$ | $R^2$ | $R^3$ | $R^4$ |
|---|---|---|---|---|
| 1 | H | $C_2H_5$ | $C_2H_5$ | H |
| 2 | H | $C_2H_5$ | $C_2H_5$ | $CH_3$ |
| 3 | H | $C_2H_5$ | $CH_2—CH_2—OH$ | H |
| 4 | H | $CH_3$ | $CH_3$ | H |
| 5 | H | $C_2H_5$ | $CH_2—CH_2—OH$ | $CH_3$ |

TABLE 1-continued

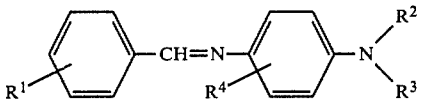

| No. | $R^1$ | $R^2$ | $R^3$ | $R^4$ |
|---|---|---|---|---|
| 6 | H | $CH_3$ | $CO-CH_3$ | H |
| 7 | H | $CH_3$ | H | H |
| 8 | H | $C_2H_5$ | $CH_2-CH_2-NH(SO_2CH_3)$ | $CH_3$ |
| 9 | 4-OH* | $C_2H_5$ | $C_2H_5$ | H |
| 10 | 3-OH* | $C_2H_5$ | $C_2H_5$ | H |
| 11 | 2-OH* | $C_2H_5$ | $C_2H_5$ | H |

*The preceding numeral indicates the position of $R^1$.

The Schiff's bases to be used according to the present invention may be prepared by known methods of condensation of the corresponding aromatic aldehydes and p-phenylene diamine derivatives in the presence of an inert solvent. The free p-phenylene diamines, which are sensitive to oxidation, are obtainable by preparation of the free base from the corresponding salt by the addition of sodium acetate to the reaction solution during the reaction.

Preparation of some of the compunds is described in detail below; the others may be obtained in analogous manner.

Preparation of Compound 2

53.2 g (0.25 mol) of 4-N,N-diethylamino-2-toluidine hydrochloride, 34 g of sodium acetate$\times 3H_2O$ and 25.3 ml of benzaldehyde in 300 ml of toluene are heated under reflux in a water separator with stirring until the separation of water has been completed. The precipitated salt is filtered off after cooling and the reaction solution is treated several times with Fuller's earth and active charcoal. The solvent is then distilled off under vacuum and the residue dissolved in ether. The ethereal solution is washed with sodium bicarbonate and water until neutral, treated with Fuller's earth and alumina and dried, and the ether is distilled off. Yield: 38 g of a dark brown oil.

| Analysis: | % | C | H | N |
|---|---|---|---|---|
| | Calc. | 81.16 | 8.3 | 10.52 |
| | Observed | 81.5 | 7.7 | 10.5 |

Preparation of Compound 11

131.1 g of 4-N,N-diethylaminoaniline sulphate, 136.1 g of sodium acetate.$3H_2O$ and 61 g of 2-hydroxybenzaldehyde in 500 ml of benzene are heated under reflux with stirring, using a water separator, until the separation of water has been completed. The reaction product is suction filtered after cooling and recrystallised twice from acetone. Yield: 94.3 g, melting point: 102°–103° C.

The compounds to be used according to the present invention are eminently suitable for increasing the stability of latent image nuclei in light-sensitive photographic materials having at least one silver halide emulsion layer. Excellent stability of the latent image nuclei is achieved even if the materials are stored for prolonged periods at normal temperature or at elevated temperatures in the heating cupboard, and at the same time the usual photographic properties which, of course, depend to a large extent on the composition of the silver halide emulsion, are preserved.

The compounds to be used according to the present invention are added to the photographic material, in particular after physical ripening of the emulsion. The derivatives are preferably added as solutions to the light-sensitive silver halide emulsion during or after chemical ripening or to the finished casting solution. Suitable solvents include in particular lower aliphatic alcohols, tetrahydrofuran, acetone and mixtures thereof. The concentration of the compounds in the photographic materials may vary within wide limits and depends on the desired effect, the nature of the reproduction process and the composition of the photograhic material.

Quantities up to a maximum of $10^{-2}$ mol, in particular a maximum of $10^{-3}$ mol, per mol of silver halide have proved to be suitable. Concentrations of from 10 to 1000 mg per mol of silver halide are particularly preferred.

The compounds to be used according to the present invention may be used for stabilising the latent image nuclei in the conventional light-sensitive materials suitable for the production of black-and-white images, e.g. materials for producing black-and-white originals or black-and-white copying materials or reversal materials. The materials may also contain colour couplers without these imparing stabilisation.

The light-sensitive materials are primarily silver halide materials capable of complete development, containing the conventional silver halide emulsions which produce a negative image on development, including reversal materials in which the first development is followed by fogging and then a second development.

As protective colloids or binders for the silver halide emulsion layer there may be used the conventional hydrophilic film-forming agents, such as proteins. In particular gelatine, alginic acid or derivatives thereof, such as esters, amides or salts, cellulose derivatives such as carboxymethyl cellulose and cellulose sulphates, starch or derivatives thereof or hydrophilic synthetic binders, such as polyvinyl alcohol, partially saponified polyvinyl acetate and polyvinyl pyrrolidone. The layers may also contain solutions or dispersions of other synthetic binders in admixture with the hydrophilc binders, e.g. homo- or copolymer of acrylic or methacrylic acid or derivatives thereof, such as esters, amides or nitriles, or vinyl polymers, such as vinyl esters or vinyl ethers.

The conventional layer supports may be used for the materials according to the present invention, e.g. supports of cellulose esters, such as cellulose acetate or cellulose acetobutyrate, or polyesters, in particular polyethylene terephthalate or polycarbonates, in particular those based on bis-phenylol-propane. Supports made of paper are also suitable; these may contain water-impermeable polyolefin layers, e.g. of polyethylene or polypropylene. Glass or metal supports may also be used.

The conventional silver halide emulsions are suitable for the purposes of the present invention. They may contain silver chloride, silver bromide or mixtures thereof, optionally with a small silver iodide content of up to 10 mol %.

The emulsions may also be chemically sensitised, e.g. by the addition of sulphur compounds, such as allyl isothiocyanate, allyl thiourea or sodium thiosulphate, at the stage of chemical ripening, or by the addition of selenium compounds. Reducing agents may also be used as chemical sensitisers, e.g. the tin compound described in Belgian Pat. Nos. 493,464 and 568,687; also polyamines, such as diethylene triamine or aminomethylsulphinic acid derivatives, e.g. according to Belgian Pat. No. 547,322. Noble metals, such as gold, platinum, palladium, iridium, ruthenium or rhodium, and compounds of such metals are also suitable chemical sensitisers. The emulsions may also be sensitised with polyalkylene oxide derivatives, e.g. with a polyethylene oxide having a molecular weight of from 1000 to 20,000, or with condensation products of alkylene oxides and alcohols, aliphatic carboxylic acids, aliphatic amines, aliphatic diamines and amides.

The emulsions may also be optically sensitised e.g. with the conventional polymethine dyes, such as neutrocyanines, basic or acid carbocyanines, rhodacyanines, hemicyanines, styryl dyes and oxonols. Sensitisers of this type have been described in the work by F. M. Hamer "The Cyanine Dyes and related Compounds", (1964).

The materials may contain other stabilisers in combination with those used according to the present invention e.g. azaindenes, preferably tetra- or pentaazaindenes, in particular those substituted with hydroxyl groups or amino groups. Compounds of this type have been described in the article by Birr, Z. Wiss. Phot. 47, 2–58 (1952). Other suitable stabilisers include, inter alia, heterocyclic mercapto compunds, e.g. phenyl mercaptotetrazole, quaternary benzothiazole derivatives and benzotriazole.

The layers of the photographic material may be hardened in the conventional manner, for example with formaldehyde or halogen-substituted aldehydes containing a carboxyl group, such as mucobromic acid, diketones, methane sulphonic acid esters and dialdehydes. The photographic layers may also be hardened with hardeners of the type of epoxides, heterocyclic ethylene imines or acryloyls. The layers may also be hardened by the process according to German Offenlegungsschrift No. 2,218,009 to produce photographic materials which are suitable for high temperature processing. Hardeners of the diazine, triazine or 1,2-dihydroquinoline series may also be used to harden the photograhic layers or colour photographic multi-layered materials. Examples of such hardeners include diazine derivatives containing alkyl or aryl sulphonyl groups, derivatives of hydrogenated diazines or triazines, e.g. 1,3,5-hexahydrotriazine, fluoro-substituted diazine derivatives, e.g. fluoropyrimidine, and esters of 2-substituted 1,2-dihydroquinoline- or 1,2-dihydroisoquinoline-N-carboxylic acids. Other suitable hardeners include vinyl sulphonic acid hardeners, and carbodiimide or carbamoyl hardeners, such as those described e.g. in German Offenlugungsschrift Nos. 2,263,602; 2,225,230 and 1,808,685, French Pat. No. 1,491,807, German Pat. No. 872,153 and DDR Pat. No. 7218. Other suitable hardeners have been described for example in British Pat. No. 1,268,550.

The present invention may be applied to the production of both black-and-white images and colour photographic images. Colour photographic images may be produced, for example, by the known principle of chromogenic development in the presence of colour couplers which react with the oxidation product of colour producing p-phenylene diamine developers to form dyes.

The colour couplers may be added, for example, to the colour developer on the principle of the process of so-called "development by incorporation". According to a preferred embodiment, the photographic material itself contains the conventional colour couplers, generally incorporated in the silver halide layers. Thus, the red-sensitive layer, for example, may contain a non-diffusible colour coupler to produce the cyan partial colour image, generally a coupler of the phenol or α-naphthol series. The green-sensitive layer may, for example, contain at least one non-diffusible colour coupler to produce the magenta partial colour image, usually a colour coupler of the 5-pyrazolone or imidazolone series. The blue-sensitive layer may, for example, contain a non-diffusible colour coupler to produce the yellow partial colour image, generally a coupler containing an open-chain keto-methylene group.

Such colour couplers are known in large numbers and have been described in numerous references. References may be found, for example, in the publication, "Farbkuppler" by W. Pelz in "Mitteilungen aus den Forschungslaboratorien der Agfa, Leverkusen/Munchen", Vol. III (1961) and K. Venkataraman in "The Chemistry of Synthetic Dyes", Vol 4, 341 to 387, Academic Press, 1971.

The non-diffusible colour couplers and colour-producing compounds are added to the light-sensitive silver halide emulsions or other casting solutions by conventional methods. If the compounds are soluble in water or alkalies, they may be added to the emulsions in the form of aqueous solutions, optionally with the addition of water-miscible organic solvents, such as ethanol, acetone or dimethyl formamide. If the non-diffusible colour couplers and colour-producing compounds are insoluble in water and alkalies, they may be emulsified in known manner, e.g. by directly mixing a solution of these compounds in a low boiling organic solvent with the silver halide emulsion or first mixing it with an aqueous gelatine solution and then removing the organic solvent in the conventional manner. The resulting emulsion of the compound in gelatine is then mixed with the silver halide emulsion. Such hydrophobic compounds may also be emulsified with the aid of so-called "coupler solvents" or "oil-formers". These are generally relatively high boiling organic compounds in which the non-diffusible colour couplers and development inhibitor releasing compounds which are required to be emulsified in the silver halide emulsions are enclosed in the form of oily droplets. Information on this matter may be found, for example in U.S. Pat. Nos. 2,322,027; 2,533,514; 3,689,271; 3,764,336 and 3,765,897.

The photographic materials may be developed using the conventional black-and-white developers, e.g. hydroquinone, pyrocatechol, p-methylaminophenol and 1-phenyl-3-pyrazolidone, and with colour developer substances, in particular of the p-phenylene diamine series, e.g. N,N-dimethyl-p-phenylene diamine, 4-amino-3-methyl-N-ethyl-N-methoxyethylaniline, 2-amino-5-diethylaminotoluene, N-butyl-N-ω-sulphobutyl-p-phenylene diamine, 2-amino-5-(N-ethyl-N-β-methane sulphonamidoethylamino)-toluene, N-methyl-N-β-hydroxyethyl-p-phenylene diamine, N,N-bis-(β-hydroxyethyl)-p-phenylene diamine and 2-amino-5-(N-ethyl-N-β-hydroxyethylamino)-toluene. Other suitable colour developers have been described, for example in J.Amer.Chem.Soc. 73, 3100 (1951).

One particularly advantageous characteristic of the compounds to be used according to the present invention is that stabilisation of the latent image nuclei does not necessitate the use of particular hardeners for gelatine.

EXAMPLE 1

A highly sensitive silver iodobromide emulsion containing 6 mol % of silver iodide is prepared in the conventional manner, flocculated and freed from the soluble salts. It is then redispersed, gelatine is added and the emulsion is ripened using silver and gold compounds in known manner. The ratio of silver nitrate to gelatine in the emulsion is 1:1 and the silver content is 95 g per kg, calculated as silver nitrate.

The emulsion is divided into 11 equal parts before it is cast. The following are added to these parts, in the quantities indicated per kg, before casting:

200 mg of 4-hydroxy-6-methyl-1,3,3a,7-tetraazaindene in the form of a 1% aqueous alkaline solution; 600 mg of saponin, 10%, dissolved in water; 10 ml of a 10% aqueous formalin solution; 10 ml of a 20% aqueous potassium bromide solution; a stabiliser to be used according to the present invention, in the form of a 1% alcoholic solutions in the quantities shown in Table (2).

The emulsions are then cast on a cellulose acetate support in quantities corresponding to a silver application of 5.5 g per $m^2$, calculated as silver nitrate. The samples are dried in the conventional manner, exposed in a sensitometer behind a grey step wedge, and developed in a developer I of the composition indicated below at 20° C. for 7 or 16 minutes, respectively, after the treatments indicated in Table 2:

Sodium sulphite sicc.: 70 g
Borax: 7.0 g
Hydroquinone: 3.5 g
p-monomethylaminophenol sulphate: 3.5 g
Sodium citrate: 7.0 g
Potassium bromide: 0.4 g
made up with water to 1 liter.

The results of sensitometric examination are shown in Table 2.

TABLE 2

| Substance No. | Quantity added (mg) | (fresh) | Speed after storage: 3 days at 60° C. | Speed after storage: 30 days at room temperature |
|---|---|---|---|---|
| — | — | Blank | −6.6 | −8.2 |
| 1 | 30 | " | −2.0 | −0.8 |
| 1 | 60 | " | −0.8 | −0.5 |
| 3 | 40 | " | −2.8 | −2.0 |
| 4 | 40 | " | −3.8 | −3.0 |
| 9 | 30 | " | −2.0 | −1.0 |
| 9 | 60 | " | −0.8 | −0.6 |
| 10 | 30 | " | −1.0 | −0.5 |
| 10 | 60 | " | ±0 | −0.2 |
| 11 | 30 | " | −1.2 | −2.0 |
| 11 | 60 | " | −1.8 | −1.9 |

The speed shown in Table 2 is determined by comparison with the blank and the values are therefore given as speed differences. An increase in this value by three units denotes that the speed is doubled. The speed itself is determined at a density of 0.2 above fog.

EXAMPLE 2

Colour photographic materials for reversal processing are prepared by successive application of the layers indicated below to a layer support of cellulose triacetate covered with an adhesive layer.

I. Control Sample (1) A red-sensitised silver halide emulsion containing per kg, 70 g of gelatine, 60 g of silver (96% thereof in the form of bromide and 4% in the form of iodide) and 55 g of the cyan coupler corresponding to the following formula:

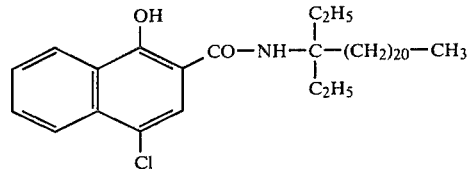

The amount of silver applied is 1.0 g per $m^2$, calculated as silver nitrate.

(2) A 2% aqueous gelatine solution containing, per kg, 4 g of the polymeric white coupler described in German Offenlegungsschrift No. 2,304,319 corresponding to the following formula

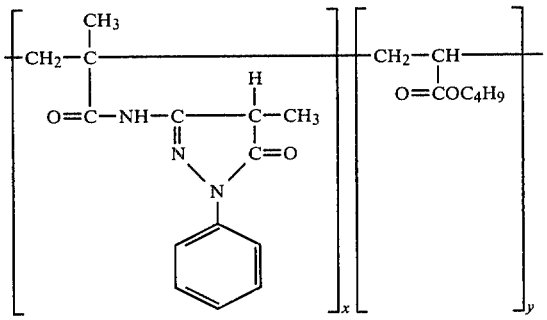

(3) A green-sensitised silver halide emulsion containing per kg, 70 g of gelatine, 60 g of silver (96% thereof in the form of bromide and 4% in the form of iodide) and 60 g of magenta coupler corresponding to the following formula:

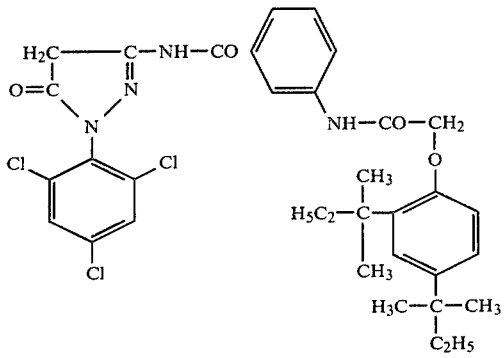

The amount of silver applied is 0.9 g per $m^2$, calculated as silver nitrate.

(4) A silver dispersion containing 1.8 g of silver, calculated as silver nitrate, and 12 g of gelatine per liter. The colour density of the yellow filter layer, determined behind a blue filter, is 0.6; the silver application is 0.2 g/$m^2$, calculated as silver nitrate.

(5) A non-sensitised silver halide emulsion containing, per kg, 70 g of gelatine, 60 g of silver (95% thereof in the form of bromide and 5% in the form of iodide) and 140 g of the following yellow coupler:

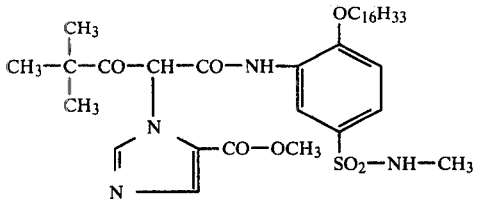

The amount of silver applied is 1.5 g per $m^2$, calculated as silver nitrate.

(6) A 1% gelatine solution in a quantity corresponding to a wet application of 60 g per $m^2$.

(7) A 1% aqueous solution of hardener corresponding to the following formula in a quantity corresponding to a wet application of 60 g per $m^2$:

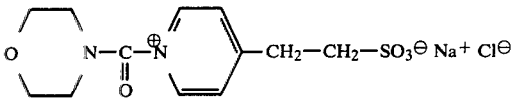

(II) Sample according to the present invention containing Compound 1

The sample is prepared as described for Sample I, but 100 mg/kg of compound 1 dissolved in methanol are added to the yellow layer (layer (5)).

Each of Samples (I) and (II) is exposed behind a graduated grey wedge, stored for 8 weeks at room temperature and then subjected to the following reversal processing at 30° C.:

Black-and-white development (developer (II)): 6 min.
Short stop bath: 2 min.
Washing: 2 min.
Diffuse second exposure
Colour development (development (III): 6 min.
Bleaching: 3 min.
Washing: 2 min.
Fixing: 3 min.
Washing: 2 min.

Baths of the following composition are used:

Developer (II)

Sodium hexametaphosphate: 2 g
Sodium carbonate sicc.: 35 g
Sodium sulphite sicc.: 50 g
1-phenyl-3-pyrazolidone 0.3 g
Hydroquinone: 6.0 g
Potassium thiocyanate sicc.: 2.0 g
Potassium bromide: 1.5 g
Potassium iodide: 10 mg
made up with water to 1000 ml and adjusted to pH 10.0.

Short stop bath

Sodium acetate sicc.: 10 g
Glacial acetic acid (96%): 30 ml
made up with water to 1000 ml and adjusted to pH 4.1.

Developer (III)

Nitrilotriacetic acid, $Na_3$ salt: 2 g
Trisodium phosphate sicc.: 20 g
Sodium sulphite sicc.: 5 g
1-(N-ethyl-N-hydroxyethyl)-3-methyl-p-phenylene diaminosulphate: 6 g
made up with water to 1000 ml and adjusted to pH 12.0.

Bleaching bath

Iron hexacyanoferrate (III): 70 g
Potassium bromide: 20 g
Disodium hydrogen phosphate sicc.: 15 g
made up with water to 1000 ml and adjusted to pH 5 with acetic acid.

Fixing bath

Sodium thiosulphate (crystalline): 180 g
Potassium metabisulphite: 18 g
made up with water to 1000 ml and adjusted to pH 5.0.

The sensiotometric determination in Table 3 shows that the photographic material containing compound 1 (Sample (II)) undergoes substantially less loss of speed of the latent image in the yellow casting than the comparison sample. Analogous results are obtained using compounds 9, 10 and 11.

TABLE 3

| | Change in speed after 8 weeks' storage at room temperature in DIN | | |
|---|---|---|---|
| Sample | Yellow | Magenta | Cyan |
| (I) | −5.6 | −1.2 | −1.4 |
| (II) | −0.5 | +0.5 | −0.1 |

An increase in the given values by 3 units corresponds to doubling of the speed.

We claim:

1. Light-sensitive photographic material containing at least one light-sensitive silver halide emulsion layer and optionally other layers, wherein at least one layer contains a compound corresponding to the following general formula (I) in a quantity of at the most $10^{-2}$ mol per mol of silver halide:

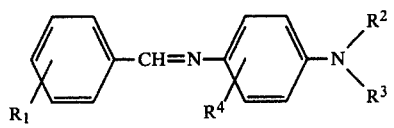

(I)

wherein $R^1$ represents H, OH or halogen;

$R^2$ and $R^3$, which may be the same or different, represent H, a substituted or unsubstituted alkyl group having from 1 to 4 carbon atoms or acyl;

$R^4$ represents H or alkyl having from 1 to 4 carbon atoms.

2. Material according to claim 1, wherein $R^1$ represents H or OH;

$R^2$ represents a substituted or unsubstituted alkyl group having from 1 to 3 carbon atoms or acetyl;

$R^3$ represents a substituted or unsubstituted alkyl group having from 1 to 3 carbon atoms or H;

$R^4$ represents H or methyl.

3. Material according to claim 1, wherein $R^1$ represents H or OH;

$R^2$ and $R^3$, which may be the same or different, represent ethyl or hydroxyethyl; and $R^4$ represent H.

4. Material according to claim 1, wherein the compound corresponding to general formula (I) is contained in a quantity of from 10 to 1000 mg per mol of silver halide.

5. Material according to claim 1, which contains at least one of the following compounds:

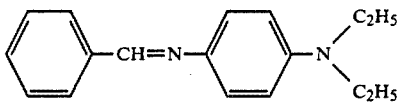

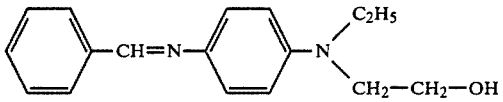

-continued

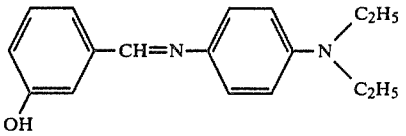

6. Process for the preparation of light-sensitive photographic materials containing silver halide by precipitation of the silver halide, ripening and application to a layer support, wherein a compound corresponding to general formula (I) defined in claim 1 is added to the silver halide emulsion before its application.

7. Process according to claim 6, wherein the addition of the compound corresponding to general formula (I) is carried out before chemical ripening.

8. Process for the production of photographic images by image-wise exposure and development of the material according to claim 1.

* * * * *